US008728295B2

(12) United States Patent
Gordon et al.

(10) Patent No.: US 8,728,295 B2
(45) **Date of Patent: *May 20, 2014**

(54) APPARATUS AND METHOD FOR REDUCING AN ALKALI METAL ELECTROCHEMICALLY AT A TEMPERATURE BELOW THE METAL'S MELTING TEMPERATURE

(75) Inventors: John Howard Gordon, Salt Lake City, UT (US); Ashok V. Joshi, Salt Lake City, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 373 days.

This patent is subject to a terminal disclaimer.

(21) Appl. No.: 12/576,977

(22) Filed: Oct. 9, 2009

(65) Prior Publication Data

US 2010/0089762 A1 Apr. 15, 2010

Related U.S. Application Data

(60) Provisional application No. 61/103,973, filed on Oct. 9, 2008.

(51) Int. Cl.
*C25C 1/22* (2006.01)
*C25C 7/08* (2006.01)

(52) U.S. Cl.
USPC ..... 205/560; 204/206; 204/252; 204/263; 205/617

(58) Field of Classification Search
CPC ..... C25C 3/02; C25C 1/00; C25C 1/02; C25B 1/00
USPC ..... 204/366, 554, 560, 617, 206–210, 252, 204/263; 205/198–201, 206–212, 215–217, 205/225, 226, 560, 617, 406, 407
See application file for complete search history.

(56) References Cited

U.S. PATENT DOCUMENTS 3,788,978 A 1/1974 Bearden, Jr. et al.
3,953,234 A 4/1976 Hoffmann (Continued)

FOREIGN PATENT DOCUMENTS

EP 0477964 4/1992
FR 2185671 1/1974
WO WO2009/070593 6/2009

OTHER PUBLICATIONS

Jo, Soo Ik "International Search Report", *International Application No. PCT/US2009/060248*, (May 26, 2010),1-3.

(Continued)

*Primary Examiner* — Nicholas A Smith
*Assistant Examiner* — Ciel Thomas
(74) *Attorney, Agent, or Firm* — David Fonda

(57) ABSTRACT

A cell having an anode compartment and a cathode compartment is used to electrolyze an alkali metal polysulfide into an alkali metal. The cell includes an anode, wherein at least part of the anode is housed in the anode compartment. The cell also includes a quantity of anolyte housed within the anode compartment, the anolyte comprising an alkali metal polysulfide and a solvent. The cell includes a cathode, wherein at least part of the cathode is housed in the cathode compartment. A quantity of catholyte is housed within the cathode compartment. The cell operates at a temperature below the melting temperature of the alkali metal.

13 Claims, 6 Drawing Sheets

(56) References Cited

U.S. PATENT DOCUMENTS

| | | | | |
|---|---|---|---|---|
| 4,320,180 | A * | 3/1982 | Nozaki | 429/418 |
| 4,544,461 | A * | 10/1985 | Venkatesan et al. | 204/265 |
| 4,986,887 | A | 1/1991 | Gupta et al. | |
| 5,141,616 | A * | 8/1992 | Heinke | 204/208 |
| 5,391,267 | A | 2/1995 | Zoppi | |
| 6,030,720 | A * | 2/2000 | Chu et al. | 429/105 |
| 6,534,668 | B2 * | 3/2003 | Backer et al. | 556/427 |
| 6,770,187 | B1 * | 8/2004 | Putter et al. | 205/560 |
| 6,939,941 | B2 * | 9/2005 | Gilmore et al. | 528/389 |
| 7,255,961 | B2 * | 8/2007 | Schucker | 429/129 |
| 8,088,270 | B2 * | 1/2012 | Gordon et al. | 205/560 |
| 2002/0053520 | A1 | 5/2002 | Shimohira et al. | |
| 2003/0103884 | A1 * | 6/2003 | Lynn | 423/220 |
| 2005/0161340 | A1 | 7/2005 | Gordon et al. | |
| 2006/0169594 | A1 | 8/2006 | Balagopal et al. | |
| 2010/0276335 | A1 * | 11/2010 | Schucker | 208/14 |

OTHER PUBLICATIONS

Jo, Soo Ik "Written Opinion of the International Searching Authority", *International Application No. PCT/US2009/060248*, May 26, 2010 ,1-4.

Kelly, Michael "Supplementary European Search Report", *European Search Report* for EP AP No. 07819989.6, Corresponding to U.S. Appl. No. 12/576,977, (Feb. 10, 2012), 1-12.

Bowen, Chris "Notice of Requisition", *Canadian Patent App.* No. 2737039 (corresponding to U.S. Appl. No. 12/576,977), (May 13, 2013),1-4.

* cited by examiner

APPARATUS AND METHOD FOR REDUCING AN ALKALI METAL ELECTROCHEMICALLY AT A TEMPERATURE BELOW THE METAL'S MELTING TEMPERATURE

CROSS-REFERENCED RELATED APPLICATIONS

This application claims the benefit of U.S. Provisional Patent Application No. 61/103,973, filed Oct. 9, 2008. This provisional application is expressly incorporated herein by reference.

BACKGROUND OF THE INVENTION

Alkali metals such as sodium or lithium metals may be used in chemical reactions. During many of these reactions, the sodium or lithium metal is oxidized to sodium or lithium cations. However, commercial processes that use sodium or lithium metal can be expensive. Accordingly, in order to reduce the costs associated with such processes, it is desirable to regenerate the sodium or lithium metal after it has been reacted. This involves reducing the formed sodium or lithium cations back to sodium or lithium metal. Once regenerated, the sodium or lithium metal may then be reused and may react with another batch of reactants. Sodium melts at about 98° C. and lithium melts at about 181° C. Regenerating sodium or lithium metals at temperatures below their respective melting temperature enables the utilization of lower cost materials; however, to date, the processes for regenerating sodium/lithium metal from the sodium/lithium cations at temperatures below their respective melting temperature are expensive and inconvenient and can involve shutting down the vessel at periodic intervals to remove the plated metal. A new process is desirable.

SUMMARY OF THE INVENTION

Sodium or lithium metal may react with sulfur or nitrogen contained in shale oil, bitumen or heavy oil. This process operates to render the shale oil, bitumen or heavy oil more suitable for commercial purposes. In turn, this reaction converts the sodium or lithium metal to sodium or lithium ions (which may be embodied in an alkali metal compound such as sodium or lithium sulfide, sodium or lithium hydrosulfide, sodium or lithium polysulfide, mixtures of solvent and other alkali metal compounds and salts such as alkali carbonate, sulfate, sulfite, chlorate, or chlorite). The exact product obtained may depend (in part) upon the conditions of the reaction. Sodium or lithium sulfide, sodium or lithium polysulfide, and/or sodium or lithium hydrosulfide or other alkali metal compounds may be considered to be intermediate compounds because such compounds may be further treated and converted (electrolyzed) in accordance with the present embodiments to regenerate the sodium or lithium metal.

One of the present embodiments operates to regenerate the sodium or lithium or other alkali metals by dissolving a quantity of an alkali metal compound in a solvent (such as a polar organic solvent). Once dissolved, the alkali metal compound may be electrolyzed in an electrochemical cell having a cathode and an anode. In this cell, alkali ions such as sodium or lithium ions are reduced to sodium or lithium metal at the cathode whereas polysulfide anions are oxidized at the anode. Such oxidation converts the polysulfide anions from low polysulfide anions to high polysulfide anions. Elemental sulfur may also be formed at the anode.

If sulfur is formed at the anode, steps may be taken to prevent the sulfur atoms from coating (passivating) the anode. Such steps may involve using a compound as part of the solvent that at least partially dissolves elemental sulfur. An example of this type of compound is N,N-dimethylaniline, quinoline, tetraethylene glycol dimethyl ether (Tetraglyme).

Cells may be constructed in which the anolyte liquid at or near the anode is removed continuously or semi-continuously. Removal of the anolyte liquid can be accomplished by pumping, overflowing, draining or other commonly performed methods. Such removal of the anolyte may allow elemental sulfur atoms (formed during the electrolytic process) to be filtered out and/or removed from the anolyte.

During the electrolytic process, sodium or lithium metal may be plated upon the cathode. This metal must be scraped or otherwise removed from the cathode so that it may be reused.

In some situations, the alkali metal plating on the cathode cannot easily be removed from a cell if the cell is operated below the melting point of the metal. Sodium melts at about 98° C. and lithium melts at about 181° C. If the cell is operated at an elevated temperature (e.g., above the metal's melting point), the plated metal will easily flow and can thus be easily separated from the cathode. If the cell is operated at lower temperatures (e.g., below the metal's melting point), no such "flowing" occurs, and as such, the plated metal can be difficult to remove from the cathode. At the same time, there are many advantages to operating the electrolytic cells at temperatures below (or substantially below) the melting point of the metal. For example, materials that will perform well at lower temperatures may be used to construct the cell. Such materials are more readily available and are lower cost than materials that are capable of operating at higher temperatures. It is also more expensive to heat up the metal to higher temperatures Moreover, it is much easier to achieve and maintain a seal on the cell (if desired) when the cell is operated at lower temperatures. Another consideration is the boiling point and flash point of the utilized solvent(s). It may be dangerous or unproductive to operate the cell at temperatures above the boiling point or flash point of the solvent.

If the cell is operated at a temperature below the metal's melting point, removal of the plated metal on the cathode may occur by periodically shutting down the cell. Once the cell is shut down, the cathode may be removed from the cell and the metal can be scraped off (stripped) from the cathode. The cathode plates are then reinserted into the cell and the cell may be turned back on. Periodically shutting down the cell may be inefficient or non-ideal. Moreover, during operation of the cell, it may be desirable to maintain constant thickness between the anode and cathode for consistent and efficient operation. Thus, in one embodiment, the cathode and anode should have a thickness that is substantially the same. As the metal becomes plated on the cathode (if not consistently removed), the gap in thickness between anode and cathode changes over time, resulting in a change in the cell's operating voltage and possibly shorting out the cell. Further, plated metal may form undesired dendrites on the cathode if the metal is not consistently removed. These dendrites may be sharp, angular metal deposits which may penetrate the cell membrane or any divider that may exist between the anode and cathode. Accordingly, it may be desirable in some embodiments to remove the plating metal consistently or semi-consistently from the cathode, while at the same time operating the cell at a temperature below the melting point of the metal.

Moreover, an entity that regenerates and/or reuses sodium/lithium cations may avoid paying any disposal fees associated with disposing of sodium/lithium compounds. At the same time, the entity may also avoid the costs associated with consistently purchasing new quantities of sodium or lithium metal. Thus, a process that can regenerate and reuse sodium or lithium metals may be commercially advantageous.

The present embodiments address these concerns. Specifically, the cell may be designed to operate below the metal's melting point and still have the metal continuously or semi-continuously removed (stripped) from the cathode. This may be accomplished by having the cathode include a band with a first portion that is within the cathode compartment and a second portion that is outside of the cathode compartment. Rollers may move the first portion of the band out of the cathode compartment and may also move the second portion of the band into the cathode compartment. The alkali metal will plate on the portion of the band that is within the cathode compartment while alkali metal previously plated on the other portion is being simultaneously stripped of the alkali metal. Thus, by moving the rollers (e.g., consistently or semi-consistently), the cell may continue to operate and plate metal on one portion of the cathode while another portion of the cathode is being stripped.

The present embodiments may provide significant advantages. For example, the present embodiments provide an electrolytic cell that can be operated to process an alkali metal compound, such as sulfide or polysulfide for example, at temperatures below the melting temperature of the alkali metal, thereby making the cell safer to operate and/or decreasing construction costs. Such an embodiment may also allow for high alkali metal polysulfides and dissolved sulfur atoms to be removed from the cell (e.g., continuously or semi-continuously). Also, solvents, sulfur, hydrosulfides, and/or alkali metal polysulfides are substantially recovered such that they can be returned back to the electrolytic process (or may be used in other applications). The present embodiments also provide an apparatus and method for generating (or regenerating) hydrogen sulfide from an alkali metal hydrosulfide.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
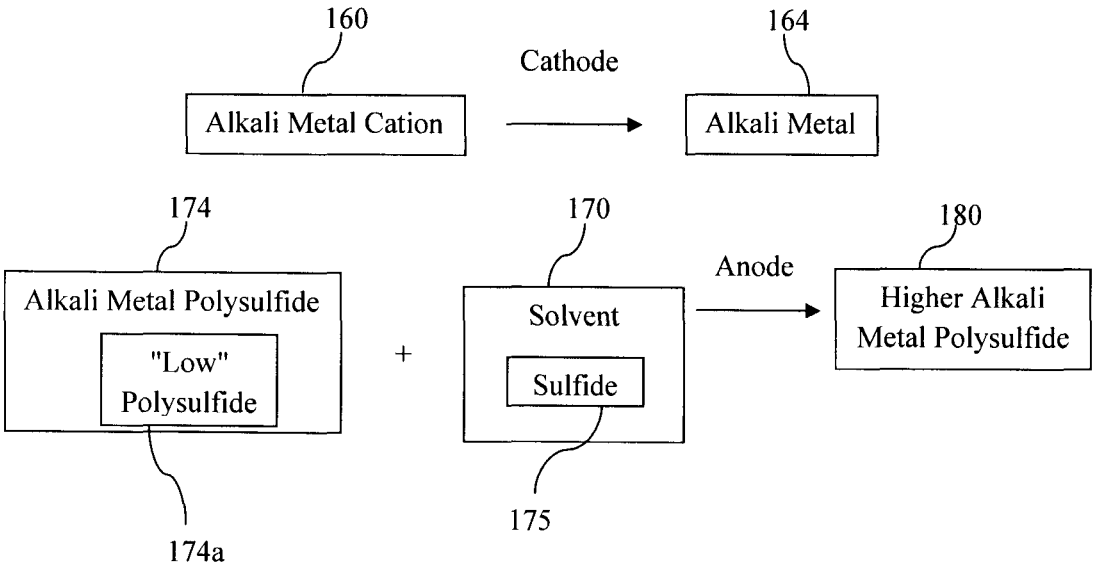
FIG. 1 is a schematic diagram illustrating chemical reactions that may occur in a electrochemical cell made in accordance with the present embodiments.

A cell for electrolyzing an alkali metal compound into an alkali metal is disclosed. In one embodiment, the alkali metal compound comprises sodium or lithium sulfide, sodium or lithium hydrosulfide, and/or sodium or lithium polysulfide. In other embodiments, the alkali metal compound comprises a mixture of solvent and other alkali metal compounds and salts such as alkali carbonate, sulfate, sulfite, chlorate, or chlorite. The cell comprises an anode compartment and an anode. At least part of the anode is housed in the anode compartment. A quantity of anolyte is housed within the anode compartment, the anolyte comprising an alkali metal compound such as those mentioned above, and a solvent. The cell further comprises a cathode compartment and a cathode, wherein at least part of the cathode is housed in the cathode compartment. A quantity of catholyte is housed within the cathode compartment. The cell operates at a temperature below the melting temperature of the alkali metal. The alkali metal is plated on the cathode during the operation of the cell. The alkali metal may be sodium or lithium. In other embodiments, the anolyte further comprises an alkali metal hydrosulfide, wherein the cell will produce a quantity of hydrogen sulfide gas during operation.

The cell may further comprise a divider that separates the cathode compartment from the anode compartment. In some embodiments, the divider is comprised of an alkali metal conductive ceramic material or glass ceramic material. The divider may be permeable to cations and substantially impermeable to anions, solvent and dissolved sulfur atoms.

The cell may be designed in which the cathode comprises a band that is moveable by at least one roller, wherein a first portion of the band is within the cathode compartment and a second portion of the band is outside of the cathode compartment. Other embodiments are designed in which the first portion of the cathode may be moved outside of the cathode compartment without disturbing the operation of the cell.

The solvent used in the anolyte may dissolve, at least partially, sulfur atoms. In some embodiments, the solvent comprises one or more of the following N,N-dimethylaniline, quinoline, tetrahydrofuran, 2-methyl tetrahydrofuran, benzene, cyclohexane, fluorobenzene, trifluorobenzene, toluene, xylene, tetraglyme, diglyme, isopropanol, ethyl propional, dimethyl carbonate, dimethoxy ether, ethanol ethyl acetate, propylene carbonate, ethylene carbonate, and diethyl carbonate. Mixtures of two or more of the foregoing may also be used as the solvent.

In some embodiments, a portion of the anolyte may be removed from the anode compartment to facilitate removal of elemental sulfur contained therein. The process for removing the sulfur atoms may include gravimetric methods, filtration methods, or centrifugation methods, or combinations of the foregoing. Further embodiments may have the sulfur removed by cooling the anolyte, precipitating the elemental sulfur, and then separating the solid phase sulfur from the liquid phase solvent.

A method for producing an alkali metal from an alkali metal compound is also disclosed. The method comprises obtaining a cell, wherein the cell comprises an anode compartment and an anode. At least part of the anode is housed in the anode compartment. A quantity of anolyte is housed within the anode compartment, the anolyte comprising an alkali metal compound, such as an alkali metal polysulfide and a solvent. The cell also comprises a cathode compartment and a cathode. At least part of the cathode is housed in the cathode compartment. A quantity of catholyte is housed within the cathode compartment. The method involves the step of operating the cell to plate the alkali metal onto the cathode, wherein the cell operates at a temperature below the melting temperature of the alkali metal.

A method for releasing hydrogen sulfide gas from an alkali hydrosulfide is disclosed. The method comprises obtaining a cell. The cell comprises an anode compartment and an anode. At least part of the anode is housed in the anode compartment. A quantity of anolyte is housed within the anode compartment, the anolyte comprising an alkali hydrosulfide and a solvent. The cell also comprises a cathode compartment and a cathode. At least part of the cathode is housed in the cathode compartment. A quantity of catholyte is housed within the cathode compartment. The method includes the step of operating the cell to release the hydrogen sulfide, wherein the cell operates at a temperature below the melting temperature of the alkali metal.

A method for releasing hydrogen sulfide gas from an alkali hydrosulfide is also disclosed. The method comprises obtaining a quantity of alkali hydrosulfide dissolved in a solvent, and reacting the alkali hydrosulfide to produce hydrogen sulfide gas and an alkali polysulfide. The solvent may further include sulfur, or alkali polysulfide. Mixtures of sulfur and polysulfide may also be used.

The embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the present embodiments, as represented in the Figures, is not intended to limit the scope of the invention, as claimed, but is merely representative of embodiments of the invention.

Sodium metal or lithium metal may be used in many industrial processes. One example of such a process is the use of sodium metal or lithium metal to react with shale oil, heavy oil, or bitumen. This reaction upgrades the purity of the shale oil, heavy oil, or bitumen as it reacts with sulfur or nitrogen (or sulfur and nitrogen containing compounds) found therein. The sodium or lithium metal is oxidized into sodium or lithium cations during the reaction. However, it may be desirable to later regenerate the sodium or lithium metal so that this "batch" of sodium/lithium metal may be re-used at a later date.

Upgrading shale oil, heavy oil, or bitumen using an alkali metal results in a stream or product consisting in part of alkali metal cations and an alkali metal compounds such as alkali metal sulfide, polysulfide and/or hydrosulfide such as sodium hydrosulfide (NaHS), lithium hydrosulfide (LiHS), or other alkali metal compounds. These streams may be the primary source of the alkali metal and sulfur for use by the present embodiments. Specifically, the formed sodium or lithium cations may be reduced, in a cathode of a cell, back to sodium or lithium metal. At the same time, at the anode, a low alkali metal polysulfide may be oxidized to a high alkali metal polysulfide and polysulfide may be oxidized to elemental sulfur.

FIG. 1 shows a schematic of the chemical reactions that may occur in a cell. Specifically, at the cathode, a quantity of an alkali metal cations 160 (such as $Na^+$, $Li^+$, etc.) may be reduced to form a quantity of alkali metal 164 (such as sodium metal, lithium metal, etc.). At the anode, a quantity of a solvent 170 is mixed with an alkali metal polysulfide 174 (such as sodium polysulfide, lithium polysulfide, etc.). The polysulfide 174 may include a quantity of a "low" polysulfide 174*a*. The solvent 170 may also include a quantity of sulfide 175. The polysulfide may be oxidized at the anode to form a higher polysulfide 180. Elemental sulfide may also form in the oxidation reaction (from the sulfide, the polysulfide, etc.).

Figure 2:
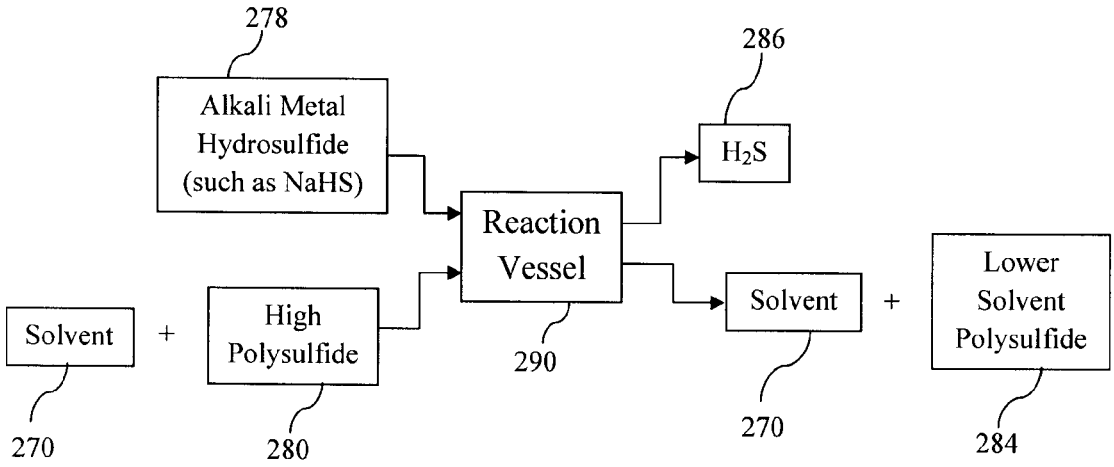
FIG. 2 is a schematic diagram illustrating a method for reacting a alkali metal hydro sulfide with a polysulfide to release hydrogen sulfide gas.

Referring now to FIG. 2, a high alkali metal polysulfide 280 may be further reacted in the presence of a solvent 270 with an alkali hydrosulfide 278 (such as NaHS, LiHS, etc.). Such reaction may occur also at the anode or may occur external of the cell, or may occur in any other reaction vessel 290. The alkali hydrosulfide 278 may be added to the anolyte or may be present as a result of the reaction of the alkali metal with the shale oil, heavy oil, or bitumen. When the alkali hydrosulfide 278 (NaHS or LiHS) is reacted with an alkali polysulfide 280 that has a high sulfur to alkali metal ratio (a "high polysulfide"), then hydrogen sulfide gas ($H_2S$) 286 will be released in the reaction. The reaction will also form a mixture having an additional alkali metal and sulfide content, wherein the sulfur to alkali metal ratio is lower than it was before the present reaction. This is a low (or lower) polysulfide 284. In the case of sodium, these reactions are described below:

$$2Na_xS_y+2NaHS \rightarrow H_2S+2[Na_{(x/2+1)}S_{(y/2+0.5)}]$$

where x:y represents the average ratio of sodium to sulfur atoms in the solution.

Thus, this reaction shows the reaction of a high polysulfide 280 (such as is formed at the anode) with sodium hydrosulfide 278 to produce a lower sodium polysulfide 284 and $H_2S$ gas 286. By reacting in this manner, the low alkali metal polysulfide formed at the anode would be generated for further conversion to a high polysulfide and ultimately to oxidized elemental sulfur and reduced alkali metal.

Figure 3:
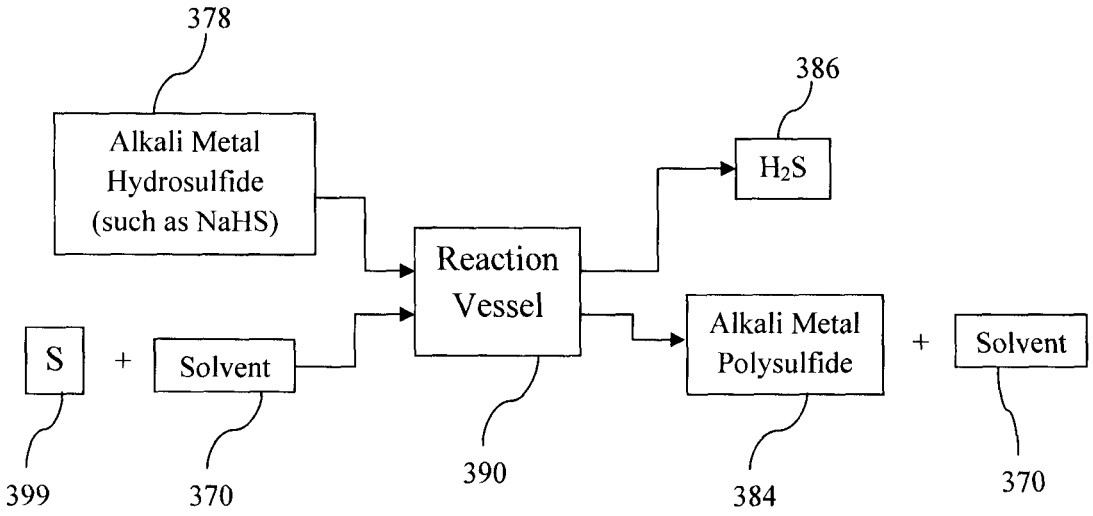
FIG. 3 is a schematic of a method for reacting alkali metal hydrosulfide with elemental sulfur to release hydrogen sulfide.

Referring now to FIG. 3, an additional reaction is described. Alternatively or additionally to the reaction outlined above, the alkali metal hydrosulfide may be reacted with sulfur:

$$YS+2NaHS \rightarrow H_2S+Na_2S_{(y+1)}$$

where Y is a molar amount of sulfur added to the sodium hydrosulfide.

Accordingly, the alkali metal hydrosulfide 378 is reacted in a vessel 390 with sulfur 399 in a solvent 370. This reaction produces another supply of hydrogen sulfide gas 386 in addition to a polysulfide 384. Again, the sulfur, hydrosulfide, sulfide (which may also be present) and/or polysulfide may be obtained by the reaction shale oil, heavy oil or bitumen reaction.

Referring now to FIGS. 1-3 generally, the overall reactions are summarized. Under the conditions associated with an electrolytic cell (e.g., an applied voltage) the above-recited reactions may occur. Sodium and lithium cations are reduced to sodium and lithium metal at the cathode. This metal will be plated upon the cathode of the electrolytic cell. The oxidation produces elemental sulfur or a higher polysulfide, which in turn, may be further reacted (regenerated) as illustrated in FIGS. 2 and 3. Thus, the polysulfide is reused. Moreover, when elemental sulfur is formed at the anode (or at other locations via the reactions discussed above), the sulfur may dissolve into the solvent. Likewise, the $H_2S$ gas that is formed may be collected, if desired, by procedures known in the art.

Figure 4:
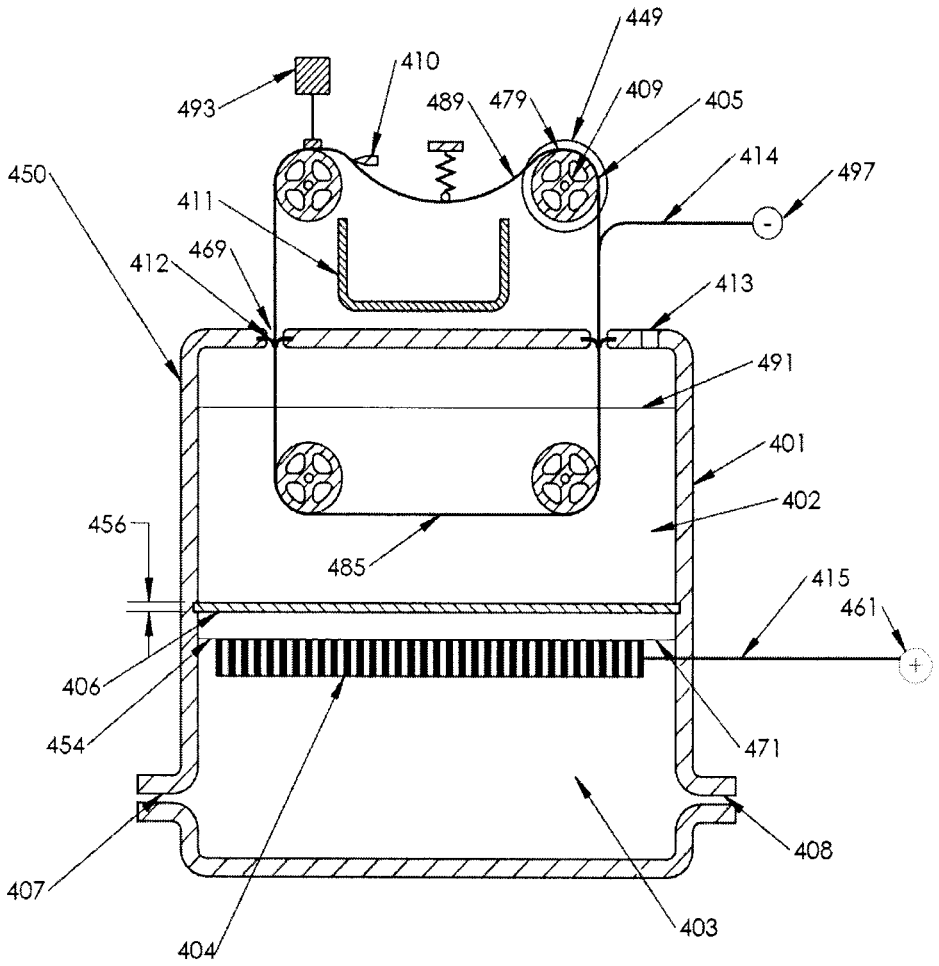
FIG. 4 shows a cross-sectional view of a cell according to the present embodiments.

An example of a cell 450 that may incorporate the above-recited reactions is shown in FIG. 4. As shown in FIG. 4, a cell housing 401 is constructed to enclose a liquid solvent mixture 454.

The material used to construct the cell housing 401 may, in some embodiments, be an electrically insulative material such as a polymer. The cell housing 401 may also be chemically resistant to solvent(s). One example of such a material that may be used to construct the cell housing 401 is Polytetrafluoroethylene (PTFE). Other embodiments may have the cell housing 401 made of a material such as high density polyethylene (HDPE) or polyvinylidene fluoride (such as is available under the trademark Kynar® sold by the Arkema, Inc. company of Philadelphia, Pa.). The cell housing 401 could also be fabricated from a non-insulative material and/or a material that is non-chemically resistant, provided the interior of the housing 401 is indeed lined with a material that is insulative and chemically-resistant. Other examples of suitable materials that may be used to construct the cell housing 401 include inorganic materials such as alumina, silica, alumino-silicate and other insulative refractory or ceramic materials. Other types of materials may also be used.

The cell housing 401 defines a cathode compartment 402 and anode compartment 403. The cathode compartment 402 may be separated from the anode compartment 403 by a divider 406. In some embodiments, the divider 406 may be substantially permeable to cations. At the same time however, the divider 406 may be substantially impermeable to anions, polyanions, and dissolved sulfur. Thus, cations may flow through the divider 406 whereas anions, polyanions (polysulfides), and/or dissolved elemental sulfur atoms cannot flow through the divider 406.

In some embodiments, the divider 406 may be fabricated, at least in part, from an alkali metal ion conductive material. If the metal to be recovered by the cell is sodium, then a particularly well suited material that may be used to construct the divider 406 is known as Nasicon. Nasicon typically has a relatively high ionic conductivity at room temperature and temperatures below the melting temperature of sodium metal. A typical Nasicon composition is substantially $Na_{1+x}Zr_2Si_xP_{3-x}O_{12}$ where $0<x<3$. Alternatively, if the metal to be recovered in the cell is lithium, then a particularly well suited material that may be used to construct an embodiment of the divider 406 is lithium aluminum titanium phosphate. Lithium aluminum titanium phosphate has a composition that is substantially, $Li_{(1+x+4y)})Al_xTi_{(1-x-y)})(PO4)_3$ where $0<x<0.4$, $0<y<0.2$. Of course, in other embodiments, the divider 406 may be constructed of other materials. Both Nasicon and lithium aluminum titanium phosphate are commercially available materials.

The divider 406 may have a thickness, as shown by numeral 456. The thickness 456 depends upon the particular embodiment. In some embodiments, a portion of this thickness 456 has a negligible through-porosity. As a result, liquids in the anode compartment 403 and cathode compartment 402 cannot pass from one compartment to the other. Rather, only cations (such as sodium ions or lithium ions) can pass from the anode compartment 403 through the divider 406 to the cathode compartment 402. In order to further augment the passing of cations through the divider 406, the divider 406 may also comprise (at least in part) an alkali metal conductive glass-ceramic such as is produced by the Ohara Glass company of Japan.

The cell 450 includes an anode 404 that is at least partially located within the anode compartment 403. In the embodiment of FIG. 4, the entire anode 404 is housed within the anode compartment 403. However, other embodiments may be constructed in which a portion of the anode 404 is outside of the anode compartment 403. The anode 404 may be fabricated from an electrically conductive material such as stainless steel, nickel, iron, iron alloys, and/or nickel alloys. Other materials may also be used. The anode 404 is connected, via connection 415 (such as wiring or other mechanisms), to the positive terminal 461 of a direct current power supply (not shown).

The anode 404 may be a mesh, monolithic structure which will allow a liquid anolyte 471 (which is housed in the anode compartment 403) to pass through the anode 404. In other embodiments, the anode 404 may be a monolithic structure which has other features (such as pores, etc.) that will allow passage of anolyte 471 through the anode structure. The anolyte 471 may be fed into the anode compartment 403 through an inlet 407 and may egress the anode compartment 403 through an outlet 408. Other methods for draining the anolyte (such as via overflowing, pumping, etc. may also be used). Having the anolyte 471 enter and exit the anode compartment 403 may allow the cell 450 to be operated in a continuous (or semi-continuous) fashion in that a fresh quantity of anolyte 471 may be constantly added to the cell 450. In other embodiments, the anode compartment 403 may be fed and drained with anolyte 471 through the same passage. These embodiments may also allow for continuous or semi-continuous operation.

The cell 450 may further include a cathode 405 that is at least partially housed within the cathode compartment 402. The cathode 405, like the anode 404, is electrically conductive. In the embodiment of FIG. 4, the cathode 405 is a band 479 of material (which is sometimes also referred to as a belt 479). In other embodiments, the cathode 405 may be a strip or other similar structure. As can be seen in FIG. 4, the band 479 includes a first portion 485 and a second portion 489. The first portion 485 is within the cathode compartment 402 (and thus within the cell housing 401) whereas the second portion 489 is outside of the cathode compartment 402 (and thus outside the cell housing 401). The alkali metal can plate onto the first portion 485, i.e., the portion of the cathode 405 that is within the housing 401 (and thus in contact with the liquid catholyte 491). The alkali metal can plate onto the first portion 485 of the cathode 405 in the cathode compartment 402 while at the same time the alkali metal already plated on the second portion 489 (outside of the housing) can be stripped off the band 479.

One or more rotating rollers 409 can define the path of the cathode 405. In FIG. 4, the path passes near the divider 406 in the cathode compartment 402, exits the cell housing 401, passes through a section where the alkali metal is removed from the band 479, then re-enters the housing 401 and returns near the divider 406. (This embodiment is not limiting as other paths are also possible). The rollers 409 may operate to move the band 479 such that the first portion 485 may be moved outside of the housing 401 and the second portion 489 may be moved into the housing 401. The one or more of the rollers 409 may be driven by a motor or driving mechanism 449 to cause the cathode 405 to move through an opening 469 in the housing 401 and pass out of the housing 401 continuously, semi-continuously or periodically or even at regular or irregular intervals. By moving the cathode 405 in this manner, the cell 450 may be operated continuously or semi-continuously, allowing the alkali metal to be plated and removed from the cathode 405 simultaneously.

In some embodiments, one or more of the rollers 409 may be attached to one or more tensioning devices 493 as desired to allow the cathode 405 to remain at an acceptable level of tension as the band 479 expands or contracts with temperature fluctuations and strains from stress. Wiping seals 412 remove catholyte 491 from the cathode 405 as the liquid egresses from the cell 450 so that the catholyte 491 is returned back to the cathode compartment 402. The band 479 may be fabricated from steel or other materials. A scraper 410 can be used to remove the plated alkali metal from the cathode 405 as it moves. Alternatively or additionally, the cathode 405 may be exposed to a heated zone that melts the alkali metal off of the cathode 405. The alkali metal may fall into a container 411 which may have a conveyance system to transfer the alkali metal away from the cell 450 to a storage area or point of use. In this manner, the alkali metal is regenerated for later use.

The cathode 405 is polarized by a connection 414 to the negative terminal 497 of a direct power supply (not shown). This connection may be made with an electronically conductive brush that contacts the cathode 405 or it may be made through one or more of the rollers 409 contacting the belt 479. Wiring or other mechanisms may also be used to establish the connection. The cathode compartment 402 may have one or more ports 413. The port(s) may be an inlet port 413 to transfer in the additionally quantities of liquid catholyte 491 when required. The port(s) may also allow for the catholyte to drain out of the compartment 402 as desired. The Figure shows the cell oriented with the membranes and electrodes in a horizontal plane but it is understood that they could be oriented in a different manner such as vertical. Also the cell could be oriented such that the membrane is configured tubular where the either the anode or cathode is inside the tube and the opposing electrode is outside the tube.

It is desirable to operate the cell 450 at temperatures below the melting point of the alkali metal. Sodium melts at about 98° C. and lithium melts at about 181° C. However, removing the plated metal in the past has been difficult to accomplish at such lower temperatures. The present embodiments (such as the embodiment of FIG. 4) address such issues. As described above, the plated alkali metal may be scraped off of the band 479 outside of the housing 401, while at the same time the plating process is occurring on another portion of the band 479. Thus, the cell 450 does not have to be turned off to remove the plated metal. Further, if the plated alkali metal is heated above its melting point to facilitate its removal from the cathode 405, such heating occurs outside of the housing 401 and does not heat the solvent to a temperature above the solvent's boiling point or flash point. Accordingly, the likelihood that the solvent will boil or exceed its flash point temperature is reduced.

The cell 450 of FIG. 4 has been described generally. Now the operation of the cell 50 will be described, with particular reference to how the cell may be used in conjunction with sodium or lithium metal and an alkali metal polysulfide.

In the embodiment of FIG. 4, the cathode compartment 402 includes the liquid catholyte 491. The catholyte 491 may include a quantity of alkali metal polysulfide (shown in FIGS. 1-3) and/or alkali metal sulfide (shown in FIG. 3). As part of the catholyte 491, there may be an alkali ion conductive liquid. Examples of alkali ion conductive liquids include polar solvents such as tetraglyme, diglyme, dimethyl carbonate, dimethoxy ether, propylene carbonate, ethylene carbonate, diethyl carbonate and mixtures of the foregoing thereof. Other alkali ion conductive liquids may also be used. In addition to the alkali ion conductive liquids, the catholyte 491 may include a quantity of an appropriate alkali metal salt such as a chloride, bromide, iodide, perchlorate, hexafluorophosphate or mixtures of any of the foregoing. Thus, if sodium is the alkali metal that is being plated, the alkali metal salt may be sodium chloride, sodium bromide, sodium iodide, sodium perchlorate, sodium hexafluorophosphate or mixtures of the foregoing. If the alkali metal being plated is lithium, the alkali metal salt may be lithium chloride, lithium bromide, lithium iodide, lithium perchlorate, lithium hexafluorophosphate, or mixtures of the foregoing. Other alkali metal salts may also be used.

The anode compartment 403 includes the liquid anolyte 471. The anolyte 471 may include a solvent (shown in FIGS. 1-3). In some embodiments, this solvent may be a polar solvent and/or a solvent that dissolves, at least partially, elemental sulfur (sulfur atoms). Examples of the solvents that may be used as part of the anolyte include: N,N-dimethylaniline, quinoline, tetrahydrofuran, 2-methyl tetrahydrofuran, benzene, cyclohexane, fluorobenzene, trifluorobenzene, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate. Mixtures or combinations of one or more of the above-recited solvents may also be used. Additional types of solvents are also possible.

The anolyte 471 may further include a quantity of dissolved alkali metal polysulfide (not shown in FIG. 4) or sulfide (not shown in FIG. 4). This alkali metal polysulfide may be obtained in a variety of different ways. One way of obtaining the alkali metal polysulfide is to react shale oil, heavy oil or bitumen with sodium or lithium metal. The anolyte 471 may also include a quantity of alkali hydrosulfide which may also be obtained from any number of sources, including the reaction of shale oil, heavy oil or bitumen with sodium or lithium metal. Sulfur and solvent may also be present in the anolyte 471. During the electrochemical reaction at the anode, a low alkali metal polysulfide is oxidized to a high alkali metal polysulfide. Elemental sulfur may also be formed during this oxidation (from the sulfide, polysulfide, etc.). In turn, this high alkali metal sulfide may react (either in the anode compartment 403 or in some other location) to produce hydrogen sulfide ($H_2S$) gas, as outlined by the chemical reaction above. This gas will be evolved such as from the housing 401. In some embodiments, the gas may be collected so that it may be properly disposed of or reused in another process. In addition, the quantity of alkali hydro sulfide could be added to the anolyte stream somewhere in the process, for example, at a location where it is convenient to collect the evolving hydrogen sulfide. Further, sulfur present in the system could also react with the hydrosulfide to produce a polysulfide and $H_2S$ gas in the manner outlined above. Thus, the polysulfide oxidized by the anode may thus be regenerated by the hydrosulfide reaction.

When connected to an operable direct current source, there is an electrical potential between the anode 404 and the cathode 405 that is greater than the decomposition voltage which ranges between about 1.8V and 2.1 V. Concurrently, sodium ions (or lithium ions) may pass through the divider 406 into the cathode compartment 402. Sodium ions (or lithium ions) are reduced to the metallic state and plate onto the cathode belt 479, and polysulfide is oxidized at the anode 4 such that low polysulfide anions become high polysulfide anions and/or elemental sulfur forms at the anode 404. When the sulfur is formed, it may be fully or partially dissolved into the electrolyte (anolyte). The sodium (or lithium) plated onto the belt 479 is removed from the cell housing 401 as the cathode belt 479 is advanced by the rollers 409. Subsequently the alkali metal is removed from the cathode belt 479 by scraping or melting outside of the cell 450.

The embodiment of FIG. 4 is designed such that a portion of the cathode 405 is within the cell 450 and a portion of the cathode 405 is outside the cell 450, thereby allowing for continuous or semi-continuous operation. The cell 450 could also be designed to operate in a "batch mode" where the cathode 405 is wholly or partially within the cell 450 and the cathode 405 is periodically removed from the cell 450 after it has been turned off and the alkali metal is stripped, melted, or otherwise removed from the cathode 405 outside of the cell 450.

A variety of different compounds may be formed in the anode or from the chemical reactions described herein. The exact amount of each product (if found) will depend upon reaction conditions, the voltage applied, the amount of sodium/lithium hydrosulfide, the molar ratios of sodium to sulfur atoms in the solution, the presence (and/or amount) of sulfur atoms, and/or other factors. The amounts of each such component may also depend upon the starting material (such as the particular batch of shale oil, heavy oil, or bitumen). In other embodiments, sulfur and/or additional makeup alkali metal sulfide, hydrosulfide, or polysulfide may be added directly to the electrolyzer (anolyte or catholyte). In addition, an alkali hydrosulfide could be added to the anolyte stream at a point in the process, for example, at a location where it is convenient to collect the evolving hydrogen sulfide formed by the reaction with hydrosulfide. The reaction conditions may be adjusted to change the products created, as desired.

With respect to the sulfur that is produced in the anode compartment 403, tetraglyme (TG) alone can dissolve sulfur formed at the anode to an extent, particularly if the cells operate at temperatures above 50° C. The solubility of the sulfur in TG rises with increasing temperature. Selected solvents such as N,N-dimethylaniline (DMA) (or other apolar solvents) may be added to TG to further increase the sulfur solubility. This apolar solvent may prevent (or reduce) polarization or passivation at the anode 404, thereby allowing the solvent to dissolve more sulfur and allowing the cell to operate more efficiently. The solvent may be particularly selected such that it will have the ability to, at least partially, dissolve the sulfur, thereby preventing the solid sulfur from interfering with the operation of the electrochemical cell 450. The ability of the solvent to dissolve the sulfur may allow the cell 450 to be operated continuously or semi-continuously.

The sulfur solubilities versus temperature for tetraglyme, DMA and mixture of tetraglyme and DMA, 80:20 by weight are shown below:

Sulfur solubility in solvents versus temperature (wt %)

| Temp ° C. | TG | DMA | 80:20 TG:DMA |
|---|---|---|---|
| 25 | 0.16 | 3.37 | 0.46 |
| 50 | 1.01 | 6.92 | 1.26 |
| 70 | 1.16 | 10.7 | 1.89 |

Figure 6:
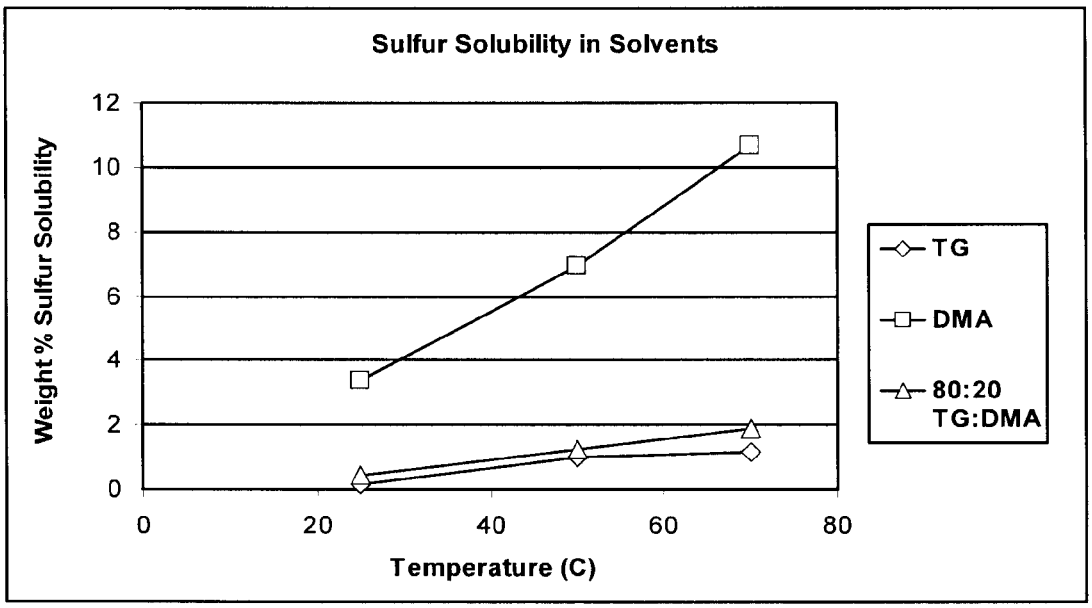
FIG. 6 is a chart illustrating the solubility of sulfur in selected solvents and solvent mixtures.

These solubility results are also represented graphically in FIG. 6.

If the cell 450 operates at a slightly elevated temperature (such as, for example, 70° C.), an embodiment may be constructed in which a stream of anolyte 471 that is nearly saturated with dissolved sulfur can be brought outside the cell 450 and chilled (using a heat exchanger or other cooling apparatus). The anolyte may exit the anode compartment 403 through outlet 408. In such embodiments, the chilling of the solvent causes the sulfur to precipitate out of solution. The solid sulfur can be removed by filtration, gravimetrical process(es), centrifugation, and/or other similar processes. Sulfur has nearly two (2) times the specific gravity of the solvent mixture and is easily separated, especially when chilled. The sulfur-depleted solvent then can be returned to the anolyte 471, thereby reducing the overall sulfur concentration in the anolyte 471 within the cell. The inlet 407 and the outlet 408 of the anode compartment 403 allow for easy removal (and reintroduction) of this solution. If the solvent is removed and then reintroduced in a continuous or semi-continuous manner, the cell 450 may operate continuously or semi-continuously.

Figure 5:
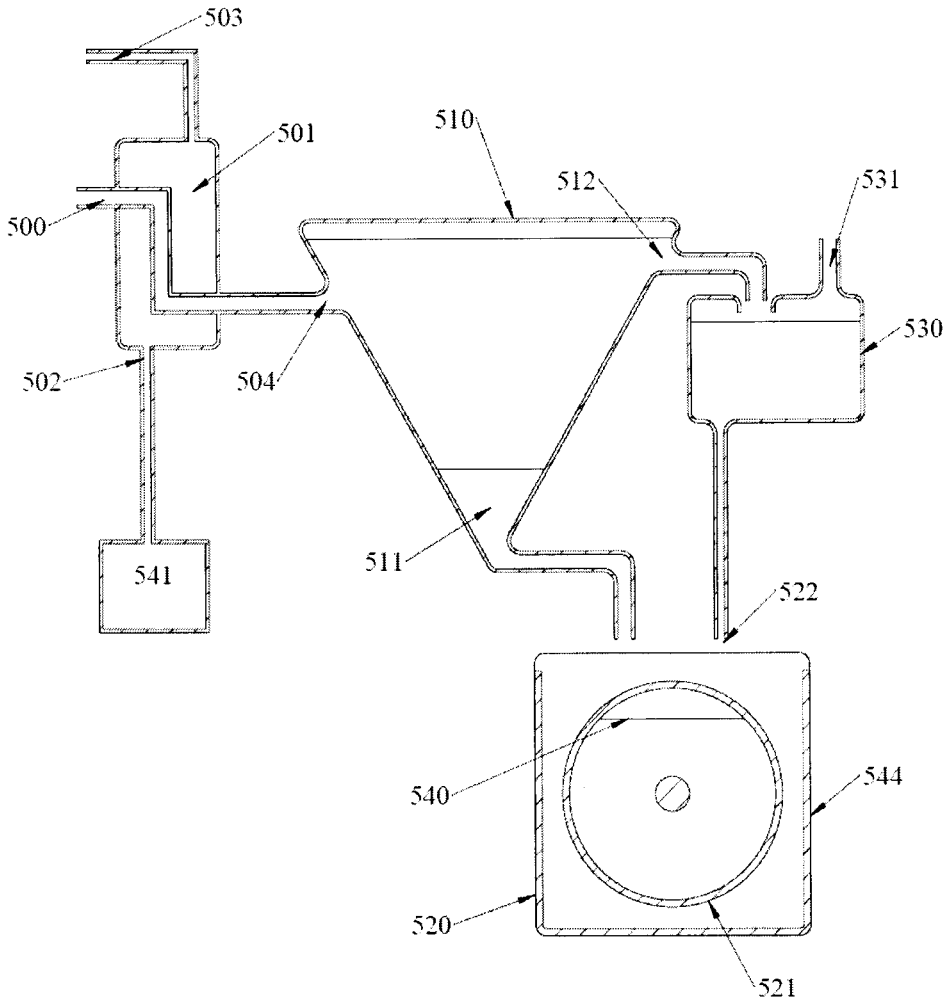
FIG. 5 is a schematic diagram of the apparatus which can process anolyte removed from the cell to extract elemental sulfur atoms.

FIG. 5 illustrates another embodiment through which the solid elemental sulfur may be removed from an anolyte 500 of a cell. As shown in FIG. 5, warm, sulfur laden anolyte 500 enters a heat exchanger 501. Coolant 502 from a chiller or cooling tower 541 cools down the anolyte 500 through a heat exchange process. Coolant 502 from the heat exchanger 501 returns back to the chiller, as represented by arrow 503. The chilled anolyte (shown as numeral 504) enters an enclosed thickener 510 to allow settling of solid phase sulfur. A stream heavily containing sulfur solids 511 flows to a rotary filter 520. Liquid anolyte flows through the filter while solid sulfur remains on the filter media that is positioned on the outside of the drum 521. Overflow anolyte 512 from the thickener 510 enters a tank 530 that also receives an external supply of solvent mixture 531. Together this stream is used as a spray 522 to wash the sulfur filtercake. The sulfur filtercake may be removed from the rotary filter enclosure 544 by a conveyor (not shown). Chilled and low sulfur bearing anolyte 540 may be pumped from the filter drum back to the electrolysis cells. This stream of sulfur-depleted liquid anolyte 540 may be heat exchanged with the stream 500 in a heat exchanger (not shown) to heat up the anolyte 540 before returning it to the cell and to reduce the temperature of the anolyte 500 entering the chilled heat exchanger 501.

The embodiment of FIG. 5 is a convenient way for separating the sulfur from the anolyte of the cell. Other methods such as centrifugation, gravimetric separations, or other filtration methods etc. may also be used.

It should also be noted that an additional quantity of an alkali metal sulfide or polysulfide may be added directly to the sulfur removal stream as shown in FIG. 5 or to an ancillary mixing chamber. In addition, an alkali hydrosulfide could be added to the anolyte stream (such as to the sulfur removal stream of FIG. 5) or at another location in the process (such as a mixing chamber).

As mentioned above, one of the likely input materials for the electrolyzer is an alkali metal compound. In one embodiment, the compound is an alkali metal hydrosulfide. FIGS. 2 and 3 schematically show how the alkali metal hydrosulfide can be reacted with the polysulfide in the anolyte stream or with sulfur to provide an alkali metal polysulfide that can be electrolyzed in the oxidation process.

The reaction vessel 290, 390 where the reaction depicted in FIG. 2 or FIG. 3 occurs could be the anode compartment of the electrolyzer depicted in FIG. 4 as described above. Other embodiments may be made in which the thickener depicted in FIG. 5 or in a separate vessel conducive to capturing and recovering the hydrogen sulfide gas generated is used for the reaction of FIGS. 2 and 3. Any vessel capable of mixing the hydrosulfide, solvent, sulfur, and/or alkali polysulfide, as needed may be used. Alternatively, sulfur generated from the process depicted in FIG. 5 could be used as an input as depicted in FIG. 3. Referring now to all of the Figures generally, an example of how a cell (such as the cell 450 of FIG. 4) may operate is described below:

Anolyte containing approximately 60-100% polar solvent such as tetraethylene glycol dimethyl ether (tetraglyme, TG), and 0-40% apolar solvent such as N,N-dimethylaniline (DMA) or quinoline, and 1% to saturation, sodium polysulfide relative to the total solvent, is fed into the anode compartment. The electrodes are energized such that there is an electrical potential between the anode and the cathode that is greater than the decomposition voltage which ranges between about 1.8 V and 2.1 V. Concurrently, sodium ions pass through the divider into the cathode compartment, sodium ions are reduced to the metallic state and plate onto the cathode belt, and polysulfide is oxidized at the anode such that low polysulfide anions become high polysulfide anions and/or elemental sulfur forms at the anode. While sulfur is formed, it is dissolved into the electrolyte. The sodium plated onto the belt is removed from the cell as the cathode belt is advanced then subsequently the alkali metal is removed from the cathode belt by scraping or melting outside of the cell. The catholyte is comprised of a polar solvent such as tetraglyme and a salt to increase the ionic conductivity. For example, in this case a sodium halide salt (such as sodium chloride) can be used to increase the ionic conductivity. The decomposition voltage of sodium chloride is also much higher than the decomposition of sodium polysulfide. The cell is operated at a temperature below the melting temperature of sodium. To avoid cell heating due to resistive losses, the anode and cathode are spaced relatively close to the divider, within a few millimeters. Adjustments to cell temperature can be made using a heat exchanger on the flow of anolyte entering the cell.

Another example is very much like the one above except lithium polysulfide is decomposed. Lithium ions pass through the divider and lithium metal is reduced at the cathode inside the cell and scraped off outside the cell. Although the present embodiments have been described in conjunction with sodium and lithium, other alkali metals may also be used.

Further, the embodiment of FIG. 4 is shown using an alkali metal polysulfide. As noted above, the reaction of bitumen, shale oil or heavy oil with sodium or lithium may also produce sodium or lithium sulfide, sodium or lithium polysulfide, and/or sodium or lithium hydrosulfide. Accordingly, embodiments may be constructed in which the anolyte includes sodium or lithium sulfide, sodium or lithium polysulfide and/or elemental sulfur. In other embodiments the teachings of the present invention may be used to recover alkali metals from other anode mixtures other than alkali polysulfides. For example alkali metal could be recovered from an anode mixture of solvent and other alkali metal compounds and salts such as alkali carbonate, sulfate, sulfite, chlorate, or chlorite.

It may be desirable to convert the sodium or lithium sulfide to sodium or lithium polysulfide within the cell and/or prior to the operation of the cell. The cell may thus allow for semi-continuous or continuous regeneration of alkali metal sulfide at temperatures below the melting temperature of the metal.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A cell for electrolyzing an alkali metal polysulfide into an alkali metal comprising:

an anode compartment comprising an inlet and an outlet;

an anode, wherein at least part of the anode is housed in the anode compartment;

a quantity of anolyte housed within the anode compartment, the anolyte comprising an alkali metal sulfide and/or an alkali metal polysulfide and an anolyte solvent that dissolves, at least partially, elemental sulfur, wherein fresh anolyte is fed into the anode compartment through the inlet and anolyte containing elemental sulfur is removed from the anode compartment through the outlet;

a cathode compartment;

a cathode, wherein at least part of the cathode is housed in the cathode compartment, wherein the alkali metal is plated on the cathode and wherein the cathode comprises a band that is moveable by at least one roller, wherein a first portion of the band is within the cathode compartment and a second portion of the band is outside of the cathode compartment, wherein the first portion may be moved outside of the cathode compartment without disturbing the operation of the cell;

a quantity of catholyte housed within the cathode compartment;

a divider that separates the cathode compartment from the anode compartment, wherein the divider comprises, at least in part, an alkali metal conductive ceramic material or glass ceramic material, and wherein the alkali metal comprises sodium or lithium, wherein the divider is permeable to cations and substantially impermeable to anions, anolyte solvent and dissolved sulfur atoms, and wherein the cell operates at a temperature below the melting temperature of the alkali metal.

2. The cell as in claim 1, wherein the anolyte solvent comprises N,N-dimethylaniline, quinoline, tetrahydrofuran, 2-methyl tetrahydrofuran, benzene, cyclohexane, fluorobenzene, trifluorobenzene, tetraethylene glycol dimethyl ether, toluene, xylene, tetraglyme, diglyme, isopropanol, ethyl propional, dimethyl carbonate, dimethoxy ether, ethanol and ethyl acetate, propylene carbonate, ethylene carbonate, diethyl carbonate, or mixtures of any of the foregoing.

3. The cell as in claim 1, wherein a portion of the anolyte is removed from the anode compartment to remove elemental sulfur contained therein.

4. The cell as in claim 3, wherein the elemental sulfur may be removed via gravimetric methods, filtration, centrifugation, and/or combinations of the foregoing.

5. The cell as in claim 3, wherein the sulfur is removed by cooling the anolyte, precipitating the elemental sulfur, and then separating the solid phase sulfur from the liquid phase solvent.

6. The cell as in claim 1, wherein the anolyte solvent is polar, wherein the anolyte further comprises an alkali metal hydrosulfide, and wherein the cell will produce a quantity of hydrogen sulfide gas.

7. A method for producing an alkali metal from an alkali metal polysulfide, the method comprising:

obtaining a cell comprising:

an anode compartment;

an anode, wherein at least part of the anode is housed in the anode compartment;

a quantity of anolyte housed within the anode compartment, the anolyte comprising an alkali metal polysulfide and an anolyte solvent that dissolves, at least partially, elemental sulfur;

a cathode compartment;

a cathode, wherein at least part of the cathode is housed in the cathode compartment, wherein the cathode comprises a band that is moveable by at least one roller, wherein a first portion of the band is within the cathode compartment and a second portion of the band is outside of the cathode compartment, wherein the alkali metal is plated on the first portion within the cathode compartment;

a quantity of catholyte housed within the cathode compartment, operating the cell to plate the alkali metal onto the cathode, wherein the cell operates at a temperature below the melting temperature of the alkali metal; and removing and recovering the plated alkali metal from the moving cathode.

8. The method as in claim 7, wherein the first portion may be moved outside of the cathode compartment without disturbing the operation of the cell.

9. The method as in claim 7, wherein a portion of the anolyte may be removed from the anode compartment to remove elemental sulfur contained therein.

10. The cell as in claim 1, further comprising a scraper disposed outside the cathode compartment to remove plated alkali metal from the cathode.

11. The cell as in claim 1, further comprising a heating zone disposed outside the cathode compartment to melt plated alkali metal from the cathode.

12. The method as in claim 7, wherein the plated alkali metal is removed from the moving cathode by a scraper disposed outside the cathode.

13. The method as in claim 7, wherein the plated alkali metal is removed from the moving cathode by a heating zone disposed outside the cathode.

* * * * *

UNITED STATES PATENT AND TRADEMARK OFFICE

CERTIFICATE OF CORRECTION

PATENT NO. : 8,728,295 B2
APPLICATION NO. : 12/576977
DATED : May 20, 2014
INVENTOR(S) : Gordon et al.

It is certified that error appears in the above-identified patent and that said Letters Patent is hereby corrected as shown below:

In the specification,

Add the following immediately after the title in Column 1, line 6:

"U.S. GOVERNMENT INTEREST

This invention was made with government support under Contract No. DE-FE0000408 awarded by the Department of Energy. The Government has certain rights in this invention."

Signed and Sealed this
Fourteenth Day of April, 2015

Michelle K. Lee

Michelle K. Lee
*Director of the United States Patent and Trademark Office*